United States Patent [19]

Grow et al.

[11] Patent Number: 4,554,814

[45] Date of Patent: Nov. 26, 1985

[54] AIR TRANSFER SYSTEM AND METHOD FOR A SHELL PRESS

[75] Inventors: Arthur L. Grow, Versailles; Charles J. Gregorovich, St. Marys; Donald N. Seyfried, New Bremen, all of Ohio

[73] Assignee: The Minster Machine Company, Minster, Ohio

[21] Appl. No.: 666,144

[22] Filed: Nov. 1, 1984

Related U.S. Application Data

[63] Continuation of Ser. No. 434,046, Oct. 13, 1982, abandoned.

[51] Int. Cl.[4] ..... B21D 22/00

[52] U.S. Cl. ..... 72/345; 72/349; 72/405; 72/427

[58] Field of Search ..... 72/347, 348, 349, 345, 72/404, 405, 427; 413/56

[56] References Cited

U.S. PATENT DOCUMENTS

| | | | |
|---|---|---|---|
| Re. 29,645 | 5/1978 | Kaminski | 72/349 |
| 1,987,101 | 1/1935 | Fabrice | 72/348 |
| 2,361,960 | 11/1944 | Pelosi | 413/56 |
| 3,293,414 | 12/1966 | Barcia . | |
| 3,645,581 | 2/1972 | Lasch, Jr. et al. . | |
| 3,812,947 | 5/1974 | Nygaard . | |
| 3,874,740 | 4/1975 | Hurd . | |
| 3,941,070 | 3/1976 | Kaminski . | |
| 3,953,076 | 4/1976 | Hurd . | |
| 3,975,057 | 8/1976 | Hurd . | |
| 4,364,255 | 12/1982 | Byrd | 72/349 |

*Primary Examiner*—Leon Gilden

*Attorney, Agent, or Firm*—Albert L. Jeffers; John F. Hoffman

[57] ABSTRACT

An air transfer system for a shell press is provided which air conveys a blanked and formed shell from a blanking and forming die station in the shell press to a curling die station in the same shell press. The air transfer system further provides for the blanked and formed part to be air conveyed within the curling die, and after the shell is curled within the die, provides for the curled shell to be air ejected from the curling die for subsequent fluid conveyance therefrom. A guide track extending between the die stations is just slightly wider than the diameter of the shell being conveyed and the fluid conveyance is provided by a hollow tube disposed in the upwardly facing surface of the guide track. A shell is air conveyed within the curling die station when an opening in a sleeve member, which is disposed about the curling die station and connected to a reciprocating blanking slide, becomes aligned with the guide track upon downward motion of the blanking slide.

28 Claims, 12 Drawing Figures

AIR TRANSFER SYSTEM AND METHOD FOR A SHELL PRESS

This is a continuation of application Ser. No. 434,046, filed Oct. 13, 1982, now abandoned.

BACKGROUND OF THE INVENTION

The invention relates to an air transfer system, and more particularly to an air transfer system for a shell press having a blanking and forming die station and a curling die station commonly operated therein.

Beverage cans, food cans and the like have a can body and separately manufactured ends, which are called shells that are sealed to the can body. Generally, the shells are manufactured from sheet steel, aluminum, or other acceptable material in a series of presses, wherein the shell is blanked and formed in one press and then transported to a second press which curls the edges of the blanked and formed shell. The uncurled shell has a peripheral edge that is generally perpendicularly disposed to the main body of the shell, and, before the shell is stacked and then sealed to the beverage can it must first be curled at its peripheral edge and then coated with a sealant which forms a resilient gasket against the can body.

A major problem currently existing in the industry is directly related to the use of separate presses to blank and form the shell and to curl the shell. Depending upon the layout of the manufacturing plant, the blanked and formed shells may first have to be stacked one upon the other and then transported to the curling die station to be curled, or the situation may arise wherein it is necessary to store stacked blanked and formed shells due to unforeseen circumstances, for example, an inoperable curler. In any event, the shapes of the blanked and formed shells permit them to be conveniently stacked since one shell tightly nests within another. However, because the blanked and formed shells tightly nest one upon the other, it is virtually impossible to mechanically cut an individual shell from a tightly nested stack of shells. This requires the shells to be stored in an unstacked state, which requires considerable space and is time consuming, costly and inefficient.

In some shell press installations, the blanking and forming die station and curling die station are in close proximity with one another so that the blanked and formed shells may be transported to the curling die station, for example, by use of a conveyor assembly. The shells are generally blanked and formed from the strip stock in groups of twelve, fourteen, or sixteen. For example, a group of sixteen may be blanked and formed from the strip stock in two rows of eight, which rows are staggered relative to each other to minimize the strip stock skeleton remaining after the blanking and forming operation. Since it is not practical to stack the blanked and formed shells, it is necessary to keep them separated from each other between the blanking and forming die station and curling die station.

A typical prior art embodiment of the above shell press installation comprises a double acting press that blanks and forms the shells, a ring curler for curling the blanked and formed shells, and a conveyor assembly extending therebetween. The blanked and formed shells may be delivered to the conveyor assembly in one of two common ways. The blanking and forming shell press may be designed to tilt towards the conveyor assembly so that the blanked and formed shells slide from the press onto the conveyor for conveyance to the ring curler, or a mechanical kicker-type device may be used with a stationary blanking and forming shell press to eject the blanked and formed shells onto the conveyor. In this particular embodiment, the ring curler generally comprises two rotating rollers between which the shells pass to be curled.

Although the above embodiment permits the blanking and forming operation and the curling operation to be performed in close proximity to each other, certain problems and disadvantages exist such as the requirement for additional space for the conveyor assembly, frequent denting of shells by the kicker device in ejecting the shells onto the conveyor assembly, and the tendency of the ring curler to produce shells having nonuniform curled edges.

Another typical prior art embodiment, which may be a modification of the above described embodiment, use a die curler in place of the ring curler. Here the blanked and formed shell is curled at a die station, which is commonly housed in a press separate from the blanking and forming shell press and operated independently thereof. The distance between the blanking and forming shell press and the die curler may be such that a conveyor assembly may be used to transport blanked and formed shells to the die curler. Stacking for transporting to the die curler is not practical due to the tight nesting of a stack of blanked and formed shells.

Concerning the conveyance of parts between different shaping operations, means other than conveyor belt assemblies have been utilized, for example, pneumatic systems which generally comprise a large plenum and duct assembly. In these systems, parts such as bottles, cans, records, silicon waffers and the like are transported along a guide track overlying the ducts. The ducts have a plurality of openings disposed therein and the plenum provides a source of low pressure air which flows through the ducts and out the openings to convey the part from one area to another. This type of system poses numerous disadvantages when adapted to a shell press wherein a plurality of shells are formed simultaneously.

Recalling from above, shells are blanked and formed in groups of twelve, fourteen, or sixteen and in rows which are staggered relative to each other such that shells formed in one row overlap shells of adjacent rows. Therefore, it is desirable to transport alternate rows along different paths or tracks, which may be disposed relative to each other in a vertically adjacent manner. In such an arrangement, it is not practical or efficient to utilize the pneumatic systems of the prior art because of the large size of the ducts that provide air flow to the tracks. Such prior art systems would be difficult to adapt to a blanking and forming die station and a curling die station operated in the same shell press, and would also require an undue amount of material and space.

Examples of such pneumatic systems may be found in U.S. Pat. Nos. 3,874,740; 3,975,057; 3,953,076; 3,941,070; 3,293,414; and 3,645,581.

SUMMARY OF THE INVENTION

The present invention eliminates the disadvantages and problems inherent in the prior art and provides certain feature unique to a shell press. Particularly, there is provided a shell press having a blanking and forming die station and a curling die station operated by a common slide assembly disposed in the shell press, thereby eliminating the need of having to stack formed and blanked shells.

Since the shells are formed, blanked and curled in the same shell press, the curled shells may be easily stacked and, more importantly, easily cut mechanically from a stack. A further advantage of utilizing a die curler in the same shell press with a blanking and forming die station is the uniform shape of curled edges produced by the die in contrast to the curled edges produced by a ring curler.

Another feature of the present invention is the provision of a unique pneumatic transfer system which is compact and easily interfaced between the blanking and forming die station and curling die station in the same shell press. Basically, the pneumatic transfer system comprises two guide tracks extending between the die stations in a double-deck arrangement. Disposed in the upwardly facing surface of each of the guide tracks is a hollow tube having a diameter much smaller than the width of the guide track or the diameter of the shell being conveyed. Each hollow tube has a plurality of uniquely shaped openings which provide air flow velocity components in the direction of the curling station, and each is connected to an air source which provides a flow of high pressure air. Because the pneumatic system of the present invention utilizes a very small diameter hollow tube in place of the large plenum and duct assembly of the prior art pneumatic systems, the pneumatic system of the present invention is easily installed between a doubledeck guide track arrangement, thereby reducing space requirements and costs.

The present invention minimizes the number of dented shells caused by mechanical kicker-type devices in ejecting the shells from a particular die station. Specifically, there is provided with the curling die station an ejecting or escapement mechanism which directs a pulse of air against a curled shell to eject the shell from the curling die station onto a guide track leading therefrom.

Broadly stated, the present invention provides a shell press for making shells for beverage cans and the like comprising a blanking and forming die station and a curling die station, both of which are operated by a common slide assembly disposed in the shell press. An ejector is provided for ejecting a blanked and formed shell from the blanking and forming die station onto a fluid conveyor device extending between the blanking and forming die station and curling die station.

Another aspect of the present invention provides a pneumatic transfer system in combination with a press including a reciprocating slide and a die station, which has a pair of cooperating tools therein. One of the tools is connected to the reciprocating slide for reciprocative movement relative to the other tool element. This pneumatic transfer system comprises a fluid conveyor track leading to the die station and a guide track leading away from the die station. Connected to the reciprocating slide to reciprocate therewith are a first wall member having a hole therein disposed between the fluid conveyor track and die station and a second wall member having a hole therein disposed between the guide track and die station. A reciprocating mechanism is provided to reciprocate the slide downwardly from its uppermost position to an intermediate position wherein the first wall opening is aligned with the fluid conveyor track to permit a part to be fluid conveyed into the station, and then to a lowermost position where the part is shaped by the tool elements. Thereafter, the reciprocating mechanism moves the slide member upwardly from its lowermost position to a second intermediate position wherein the second wall opening is aligned with the guide track and a source of air is caused to emit a pulse of air against the shaped part to eject it through the second wall opening onto the guide track. The reciprocating mechanism then moves the slide upwardly to its uppermost position for subsequent reciprocative movements.

A further aspect of the present invention is an air transfer apparatus for moving a part from a first die station to a second die station in a press installation. The air transfer apparatus comprises a guide track extending between the die stations and having an upwardly facing surface, opposed sides extending substantially the length of the upwardly facing surface, and a downwardly facing surface above the upwardly facing surface and extending substantially the length thereof. The facing surfaces and opposed sides generally define therebetween an elongated space extending between the die stations. A hollow tube member is disposed in the guide track and has a diameter much smaller than the transverse distance between the opposed sides, and has a plurality of openings therein to provide fluid communication between the hollow tube and the elongated space. The openings are shaped to provide air flow velocity components in the elongated space directed toward the second die station when a flow of air is supplied to the hollow tube by a source of air flow connected thereto.

It is an object of the present invention to provide a shell press for making shells for beverage cans and the like having a blanking and forming die station and a curling die station operated by a common slide assembly, and a fluid conveying track extending between the die stations for conveying an uncurled shell from the blanking and forming die station to the curling die station.

Another object of the present invention is to provide an air transfer system which in part utilizes a hollow tube having a plurality of openings therein for air conveying a shell from a blanking and forming station to a curling station.

A further object of the present invention is to provide a pneumatic system for air conveying a part to a die station and for ejecting the part therefrom with a pulse of air.

BRIEF DESCRIPTION OF THE DRAWINGS

The above mentioned and other features and objects of this invention, and the manner of obtaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1A:
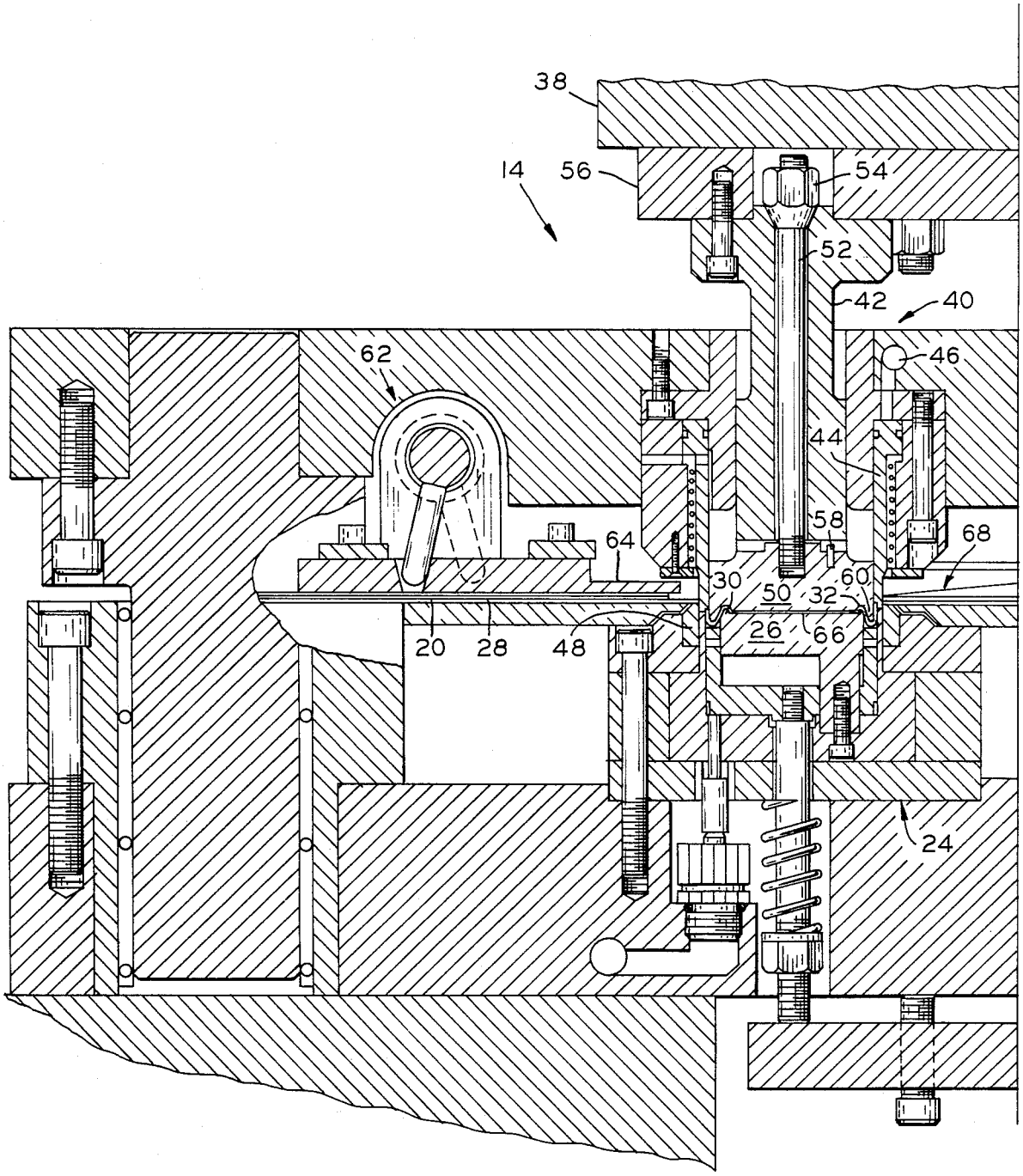
FIG. 1A is a partially broken-away and partially sectioned front elevational view of the blanking and forming die station area of a shell press incorporating the present invention.
Figure 1B:
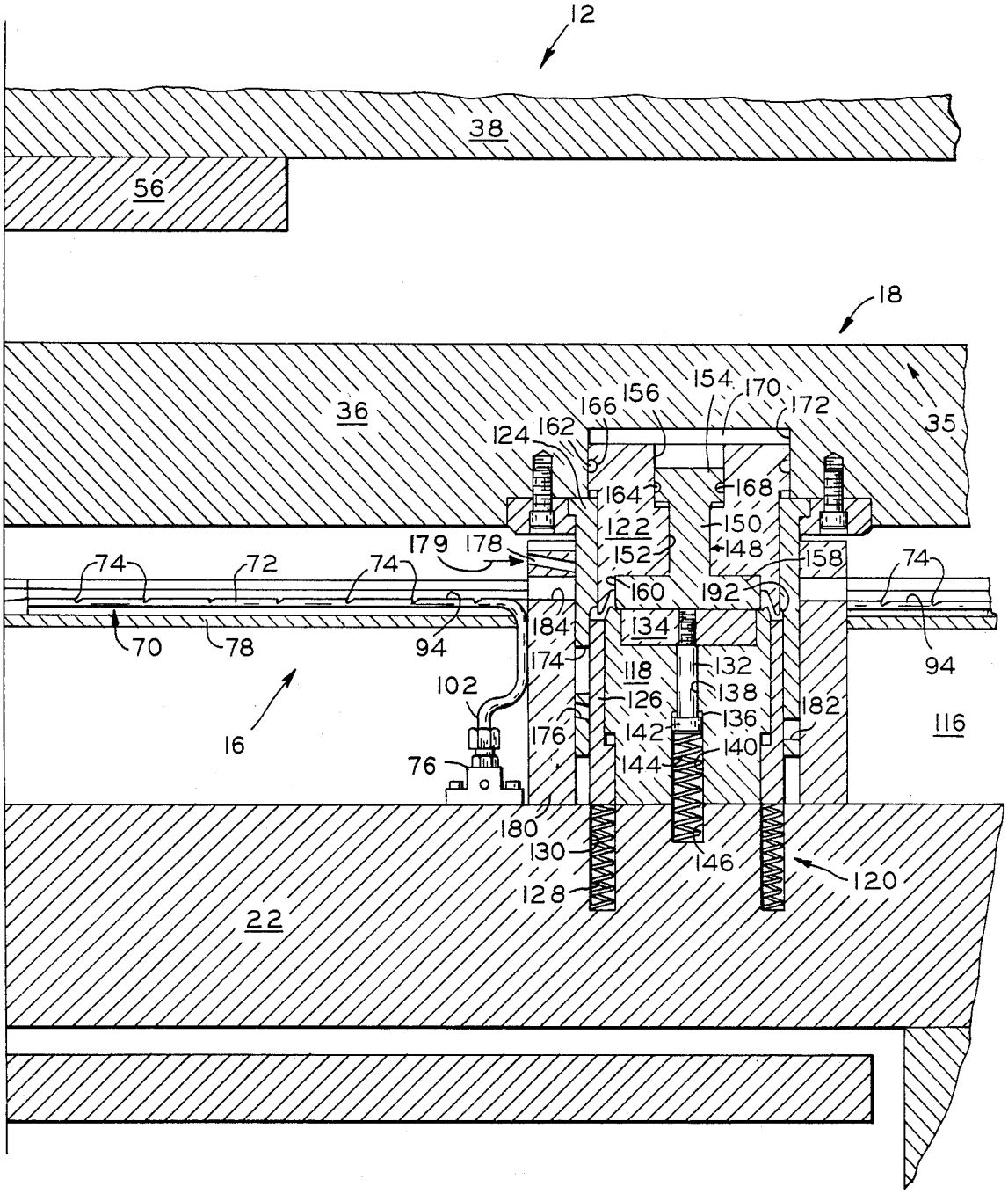
FIG. 1B is an extension of the right hand side of the shell press of FIG. 1A illustrating an air transfer apparatus extending between a blanking and forming die station and a curling die station incorporating a pneumatic transfer system.

Referring now to FIGS. 1A and 1B the relevant portion of shell press 12 is shown comprising blanking and forming die station 14, air conveyor assembly 16, and curling die station 18. Not shown in a strip stock feeder which feeds strip stock 20 to shell press 12 and a scrap cutter for collecting the skeleton of strip stock 20.

Continuing to refer to FIGS. 1A and 1B, blanking and forming die station 14 comprises stationary bolster 22 secured to a press bed (not shown) and cutting die retainer assembly 24 secured on the upper surface thereof. Lower forming die 26, the cross section of which is circular in a plane parallel to tin line 28, is securely mounted within cutting die retainer assembly 24. Bolster 22 and cutting die retainer assembly 24 are rigidly connected to the shell press frame (not shown). Lower forming die 26 also includes an annular bead portion 30, which forms a correspondingly shaped bead portion 32 in shell 66.

Double action slide assembly 35 comprises blanking slide 36 slidably received on shell press posts (not shown) and forming slide 38 slidably guided by blanking slide 36. Slides 36, 38 are driven by connecting rods and a crankshaft operated by an electric motor (not shown) similar to that shown in U.S. Pat. No. 3,902,347. Securely mounted to blanking slide 36 is housing assembly 40, which is slidably disposed with respect to spindle 42 and which retains punch 44 for slidable movement relative thereto. Air pressure from air passage 46 yieldably and continuously urges punch 44 downwardly towards annular cutting die 48 in cutting die retainer assembly 24.

Upper forming die 50 is rigidly connected to spindle 42 by retaining rod 52, which is threadedly secured at its lower end to forming die 50 and held against spindle 42 at its upper end by nut 54. Spindle 32 is secured to top plate 56, which is connected to forming slide 38. A dowel 58 prevents rotation between forming die 50 and spindle 42, and forming die 50 has an annular bead portion 60 about its periphery.

Figure 2:
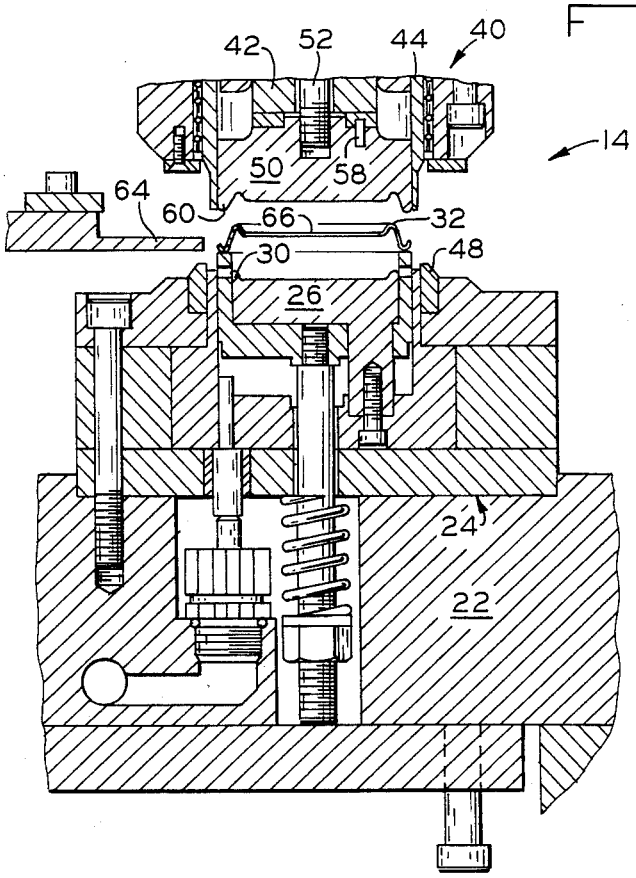
FIG. 2 is an enlarged, fragmentary, sectional view of a blanking and forming die station illustrating a blanked and formed shell ready for ejection therefrom.

Referring now to FIGS. 1A, 1B, and 2, ejector mechanism 62 has ejector bar 64 in a ready position to eject blanked and formed shell 66 from blanking and forming die station 14. When blanked and formed shell 66 is positioned as indicated in FIG. 2 during the shell press cycle, ejector bar 64 is positively moved by ejector mechanism 62 to a position wherein it contacts shell 66 and thereafter is positively, rapidly accelerated to eject shell 66 from die station 14 upwardly along incline 68 to air conveyor assemby 16.

A more detailed description and operation of die station 14 may be found in U.S. patent application Ser. No. 165,966 filed on July 7, 1980, and a more detailed description and operation of ejector mechanism 62 may be found in copending U.S. patent application entitled Cam Actuated Ejector For A Shell Press, both of which have been assigned to the assignee of the present invention.

Referring to FIGS. 1A, 1B, 3 and 7, air conveyor assembly 16 comprises elongated guide track 70, hollow tube 72 extending the length of guide track 70, shaped openings 74 disposed in hollow tube 72, and a source of high pressure air flow 76 connected to hollow tube 72 by a suitable connector. Although the disclosure is concerned with the conveyance and subsequent shaping of a single shell 66, the present invention fully contemplates a plurality of shells 66 being blanked and formed for conveyance along at least two guide tracks 70 positioned one on top of the other to a plurality of curling die stations 18.

Figure 4:
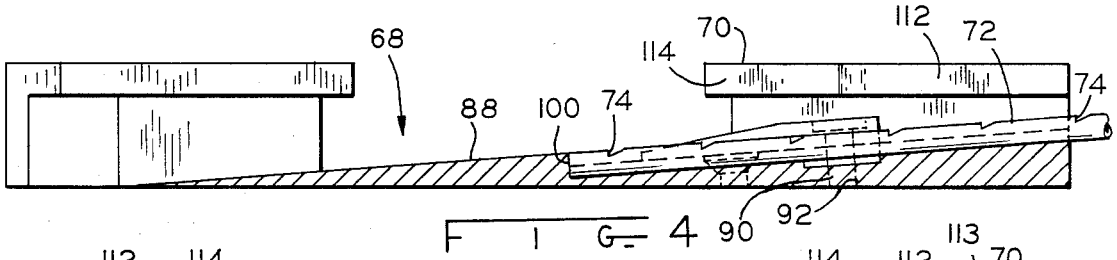
FIG. 4 is a cross-sectional view of FIG. 3 taken along line 4—4 and viewed in the direction of the arrows.
Figure 5:
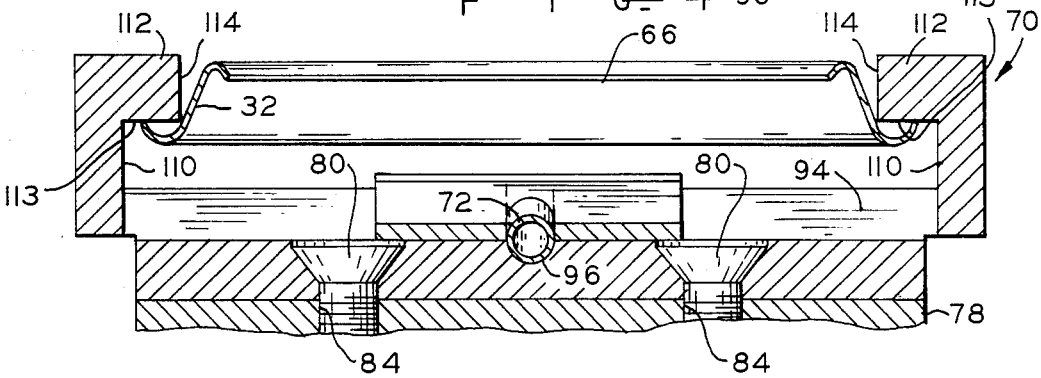
FIG. 5 is a cross-sectional view of FIG. 3 taken along line 5—5 viewed in the direction of the arrows and illustrates the position of an uncurled shell being conveyed.

In FIGS. 1A, 1B, 5, a support plate 78 extends between blanking and forming die station 14 and curling die station 18 and has incline 68 secured to its left hand end portion by screws 80 received through incline holes 82 and threaded holes 84 in support plate 78. Incline 68 has a narrow neck portion 86 (FIG. 3) for ease of installation only, and upwardly facing surface 88 (FIG. 4) of incline 68 is formed by a tapering end section of guide track 70, which is secured to support plate 78 by screws 90 received through guide track holes 92 and threaded holes (not shown) in support plate 78.

Figure 3:
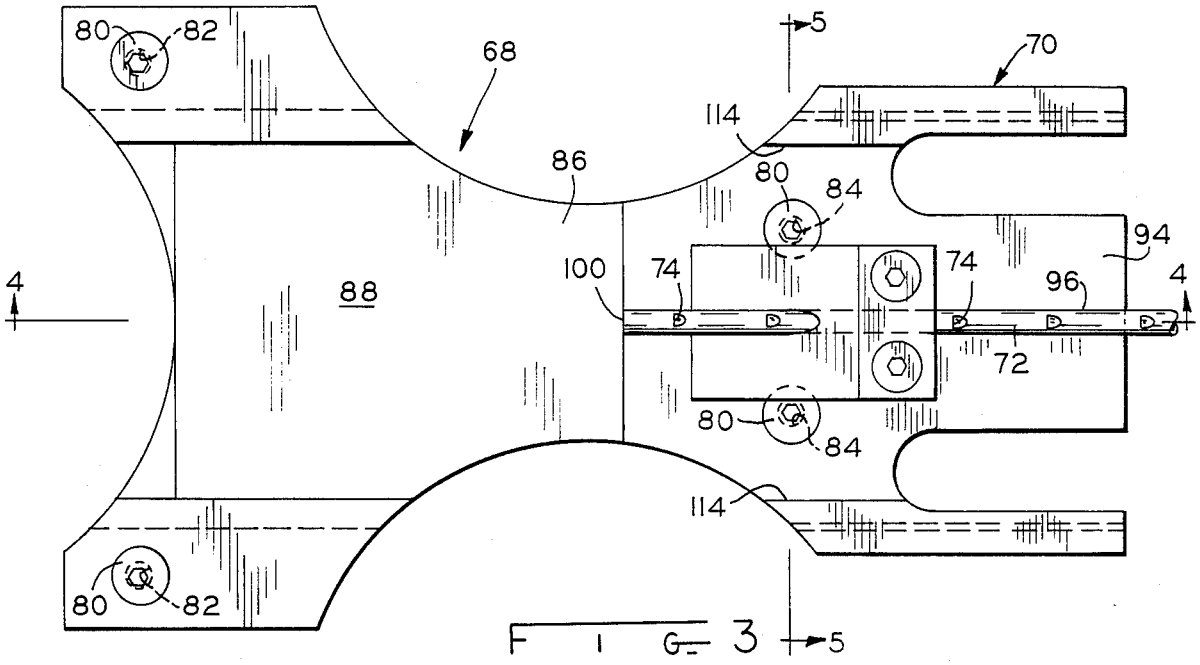
FIG. 3 is a top plan view of a portion of an air transfer apparatus.
Figure 6:
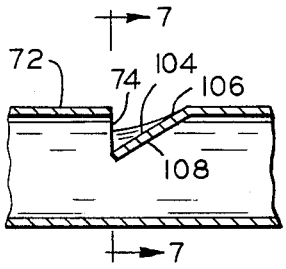
FIG. 6 is an enlarged, fragmentary, sectional view of the air transfer apparatus.
Figure 7:
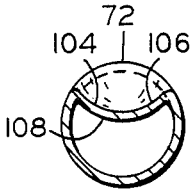
FIG. 7 is a cross-sectional view of FIG. 6 taken along line 7—7 and viewed in the direction of the arrows.

Viewing FIGS. 3 and 7, guide track 70 has an upwardly facing surface 94 with a groove 96 centrally disposed longitudinally therein. Secured within the length of groove 96 is hollow tube 72 having one end 100 closed and the other end 102 (FIG. 1B) connected to source 76 to supply high pressure air flow through the length of hollow tube 72. Important to the invention is the very small diameter of hollow tube 72 in relation to the width of upwardly facing surface 94 and the diameter of a shell 66. This allows hollow tube 72 to be easily installed in narrow spaces, for example, between guide tracks positioned one upon the other to provide fluid conveyance of shells from one area to a second area within shell press 12. Hollow tube 72 has a plurality of axially aligned shaped openings 74 uniquely stamped therein. Each stamped portion 104 (FIGS. 6, 7) of hollow tube 72 is circular and has a concave surface 106 and a convex surface 108, which faces generally inwardly of hollow tube 72. Consequently, when a supply of high pressure air is provided in hollow tube 72, a flow of high pressure air is discharged through each of the shaped openings 74 providing generally perpendicular and generally parallel velocity components relative to upwardly facing surfaces 94, whereby a shell 66 may be lifted upwardly and moved along upwardly facing surface 94 in the direction of the parallel velocity components. To confine shells 66, opposite side walls 110 (FIG. 5) upstand from upwardly facing surface 94 and each side wall 110 has an overhanging extension 112 inwardly disposed over surface 94. Side walls 110 are spaced apart a distance slightly greater than the diameter of a shell 66, and remote ends 114 of overhanging extensions 112 are spaced apart a distance slightly less than the diameter of shell 66. Side walls 110 and overhanging extensions 112 permit a shell 66 to be fluid conveyed over surface 94 in a manner depicted in FIG. 5. Note that shell 66 is lifted above surface 94 by the perpendicular velocity components exiting shaped openings 74 and moved along surface 94 by the parallel velocity components exiting shaped openings 74. Downwardly facing surfaces 113 of extensions 112 maintain conveyed shell 66 in the elongate space defined by surface 94, sidewalls 110, and extensions 112.

Figure 11:
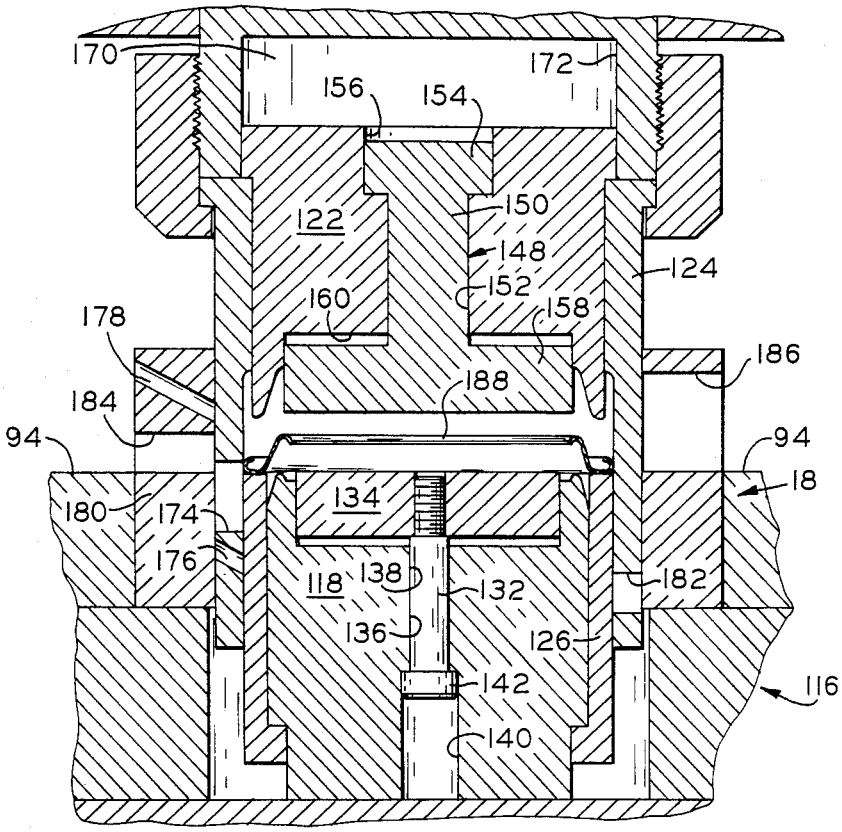
FIG. 11 is similar to FIG. 10 illustrating a curled shell in a position for ejectment from the curling die station.
Figure 8:
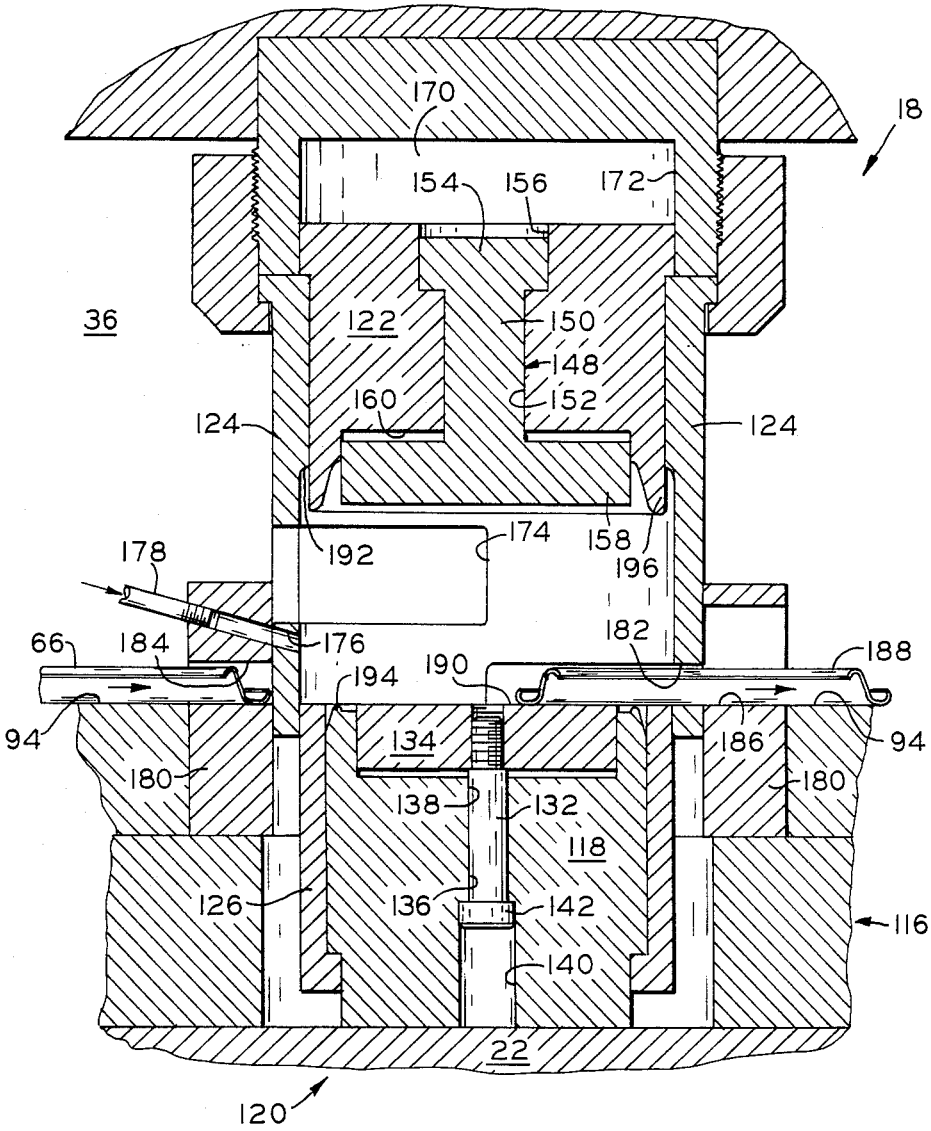
FIG. 8 is a sectional view of the curling die station depicting an uncurled shell in a stationary position out of the die station and a curled shell being ejected from the die station.

Referring to FIGS. 1B, 8, and 11, curling die station 18 comprises curling die retainer assembly 116, lower curling die 118, upper curling die 122, and sleeve 124. Curling die retainer assembly 116 is securely mounted to stationary bolster 22 and has lower curling die 118 included therein.

Annular lift out element 126 is slidably received within curling die retainer assembly 116 and about lower curling die 118. Lift out element 126 is also receivable within circular groove 130 in bolster 22, however, lift out element 126 is biased upwardly by annular spring 128 disposed within groove 130. Lift out arm 132 is slidably received within opening 136, which has a narrow upper portion 138 and a wider lower portion 140. Lift out arm 132 has cylindrical seat 134 secured to its upper end, and a small piston 142 secured to its lower end in lower portion 140 of opening 136. Lift out arm 132 is biased upwardly by spring 144, which is disposed below piston 142 and in opening lower portion 140 and cylindrical bore 146 in bolster 22.

Slidably disposed in upper curling die 122 is piston 148 which has a narrow midportion 150 slidably received within opening 152, upper portion 154 slidably received within opening 156, and lower portion 158 slidably received within opening 160. Two O-ring seals 162, 164 are disposed in respective grooves 166, 168 in upper curling die 122 and piston upper portion 154, respectively. A source (not shown) of air provides air under pressure to space 170 defined by opening 156 in upper curling die 122 and slide opening 172 in blanking slide 36 in which upper curling die 122 is slidably received.

Sleeve 124 has opening 174 disposed in its side and vertically aligned with guide track surface 94, and an angled opening 176 disposed in its side just slightly below opening 174. Opening 174 has vertical and lateral dimensions sufficient to allow a blanked and formed shell 66 to pass therethrough into curling die station 18. Conduit 178 is disposed in support 180 of curling die retainer assembly 116 and has a source 179 of air flow connected to its opposite end. A limit switch (not shown) in curling die station 18 causes the source 179 of air connected to the opposite end of conduit 178 to emit a pulse of air flow through conduit 178 when angled opening 176 becomes aligned therewith (FIG. 8). Disposed in sleeve 124 on its side opposite opening 174 and just slightly below opening 174 is opening 182 which has vertical and lateral dimensions sufficient for the ejection of a curled shell 188 therethrough.

Guide track 70 is connected to support 180, which has a hole 184 disposed therein to allow a conveyed blanked and formed shell 66 to pass therethrough into curling die station 18. Support 180 has a second hole 186 disposed therein to allow an ejected curled shell 188 to pass therethrough for further conveyance by air conveyor assembly 16 or other suitable conveying means.

Figure 9:
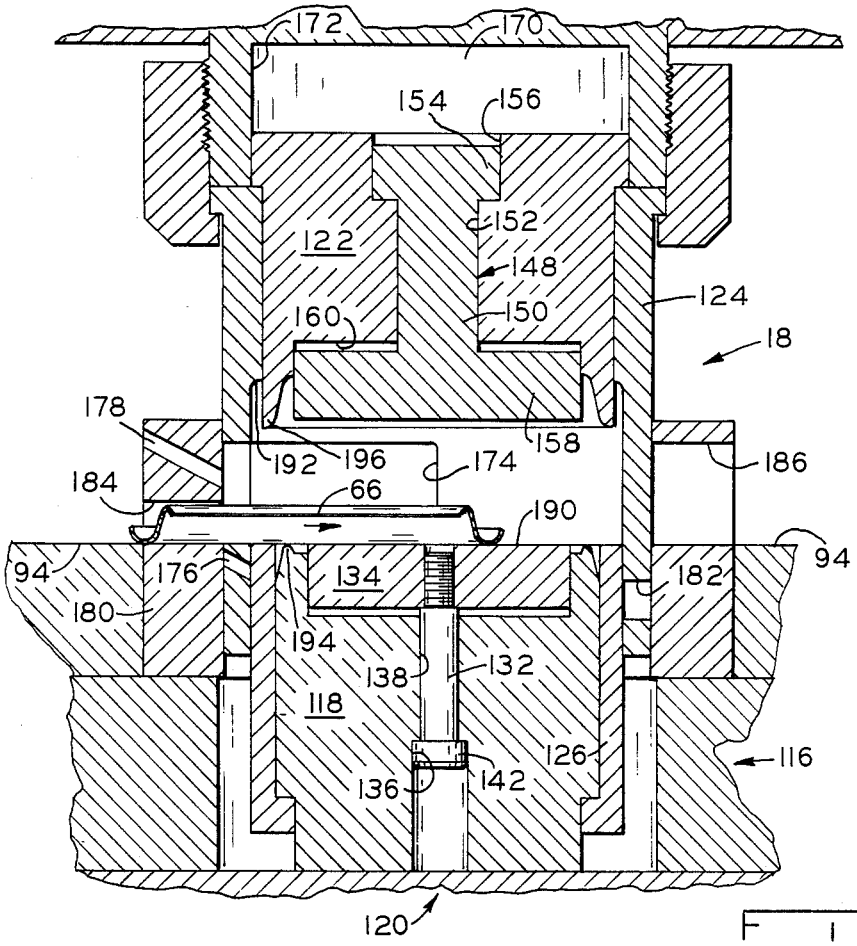
FIG. 9 is a view similar to FIG. 8 with the uncurled shell entering the curling die station.

FIG. 9 illustrates a blanked and formed shell 66 being received within curling die station 18 and it should be noted that the upper surface 190 of seat 134 is substantially coplanar with guide track surface 94 and support hole 184 so that shell 66 may be smoothly conveyed within curling die station 18. Likewise, FIG. 8 illustrates a curled shell 188 being ejected from curling die station 18, and it should be noted that upper surface 190 is substantially coplanar with support hole 186 and surface 94 of air conveyor assembly 16 or other suitable conveying means.

The blanking, forming, and curling of a shell 188 will be described, however, as earlier mentioned above, the present invention contemplates a plurality of such operations happening simultaneously. Upon receiving a portion of strip stock 20, blanking and forming die station 14 blanks and forms a shell 66 and ejector mechanism 62 ejects shell 66 onto guide track surface 94 of air conveyor assembly 16. Blanked and formed shell 66 is then conveyed from blanking and forming die station 14 to curling die station 18 by the air jets having perpendicular and parallel velocity components directed through shaped openings 74 of hollow tube 72. FIG. 5 illustrates the position of shell 66 in air conveyor assembly 16 during transport and it may be seen that shell 66 has been lifted by the perpendicular velocity components so that shell bead portion 32 is in contact with overhanging extension 112 and downwardly facing surfaces 113 to prevent shell 66 from being thrown from surface 94, and the parallel velocity components convey shell 66 over surface 94 to curling die station 18.

FIG. 8 illustrates curling die station 18 when the crankshaft (not shown) of shell press 12 is at about 0° of crankshaft rotation. Consequently, blanked and formed shell 66 is shown in its position relative to curling die station 18 at about 0° crankshaft rotation, and the previous shell is shown as curled shell 188.

Beginning at approximately 0° crankshaft rotation, blanked and formed shell 66 is positioned as illustrated in FIG. 8 in abutment with sleeve 124. As the crankshaft continues to rotate, blanking slide 36 is moved downwardly and at approximately 67° crankshaft rotation (FIG. 9) sleeve 124 has moved downwardly to align sleeve opening 174 with support hole 184 to permit shell 66 to be fluidly conveyed through hole 184, opening 174, and into curling die station 18 so that shell 66 is centrally positioned on upper surface 190 of seat 134. Throughout this evolution, space 170 has a supply of air therein at a predetermined pressure to bias piston 148 downwardly as depicted in FIG. 8.

Figure 10:
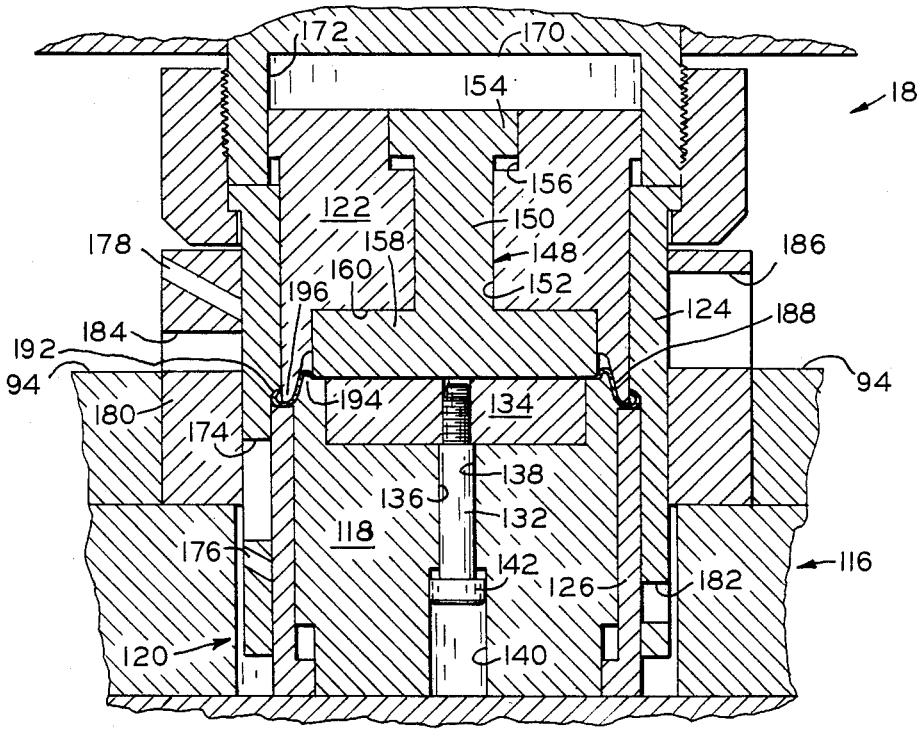
FIG. 10 is similar to FIG. 9 illustrating the shell being curled by the die station.

FIG. 10 illustrates curling die station 18 at approximately 180° crankshaft rotation. During crankshaft rotation from about 67° to about 180°, piston lower portion 158 contacts the upper surface of shell 66 to firmly hold it in place during the curling operation. As blanking slide 36 continues to move downwardly, lower curling die 118 is forced downwardly against the spring forces of springs 128, 144. After springs 128, 144 have been fully compressed, upper curling die 122 is forced downwardly by blanking slide 36 under a force that is greater than the force applied against piston 148 by the air in space 170. The greater force supplied by blanking slide 36 to upper curling die 122 causes it to curl shell bead portion 32 against inner curling surface 192 of sleeve 124. Just shortly before this curling operation, lift out arm 132 has fully compressed spring 144 so that further downward movement by seat 134 is prevented. Annular lift out element 126 then moves downwardly a small distance against spring 128 to allow die annular bead portion 196 to fully seat with die annular bead portion 194 to curl shell bead portion 32 against inner curling surface 192.

As the crankshaft rotates from about 180° to approximately 264°, the position of curled shell 188 within curling die station 18 is as illustrated in FIG. 11. As the crankshaft begins to rotate past approximately 180°, blanking slide 36 begins to move upwardly to a position where the force exerted by it on upper curling die 122 becomes less than the force exerted against piston 148 by the air within space 170. At this particular point, and as blanking slide 36 continues to move upwardly, upper curling die 122 moves upwardly so that die annular bead portion 196 separates from curled shell 188 while piston lower portion 158 remains forced against the upper surface of shell 188. Upon further upward movement by blanking slide 36, lower curling die 118 is stopped from further upward movement while liftout element 126 and liftout arm 132 move upwardly under the spring forces exerted by springs 128, 144, respectively. This causes the die annular bead portion 194 to separate from shell bead portion 32, and at this point curled shell 188 is being firmly held by seat 134 and piston lower portion 158.

As the crankshaft approaches approximately 264° rotation, blanking slide 36 continues to move upwardly to draw piston lower portion 158 away from the upper surface of curled shell 188 as depicted in FIG. 11, so that curled shell 188 now rests on lift out element 126 and upper surface 190 of seat 134 as depicted in FIG. 11.

Referring again to FIG. 8, curled shell 188 is being conveyed from curling die station 18 onto surface 94 of air conveyor assembly 16 or other suitable conveying means. As the crankshaft rotates from about 264° to about 294°, sleeve 124 moves upwardly so that sleeve opening 182 becomes aligned with curled shell 188 and sleeve opening 176 becomes aligned with conduit 178. Shortly before sleeve opening 176 aligns with conduit 178, a limit switch (not shown) in curling die station 18 is tripped to cause the source 179 of air connected to the opposite end of conduit 178 to emit a pulse of air flow through conduit 178 and sleeve opening 176 against curled shell 188 to eject it through sleeve opening 182 and support hole 186 onto surface 94 of air conveyor assemby 16 or other suitable conveying means.

As the crankshaft rotates from about 294° to about 360°, curled shell 188 is fully ejected fluidly from curling die station 18 and a second blanked and formed shell 66 is fluidly conveyed by air conveyor assembly 16 against sleeve 124 to be curled by curling die station 18.

While this invention has been described as having a specific embodiment, it will be understood that it is capable of further modifications. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A shell press for making shells for beverage cans and the like, comprising:

a slide assembly including a blanking and forming die station and a curling die station, both of said die stations being operated by said slide assembly, and a pair of reciprocative slide members, a pair of first tooling members being mounted in said blanking and forming die station for blanking and forming a shell, one of said first tooling members being operably connected to a first slide member in said slide assembly, first means for reciprocating said first slide member, a pair of second tooling members being mounted in said curling die station for curling a blanked and formed shell, one of said second tooling members being operably connected to a second slide member in said slide assembly, second means for reciprocating said second slide member, means for ejecting a blanked and formed shell from said blanking and forming die station, and fluid conveyor means extending between said die stations for conveying an ejected shell from said blanking and forming die station to said curling die station, said fluid conveyor means including a pair of opposed side walls defining a track and a hollow tube member, said tube member connected to a source of air located remotely from said track, said tube located in a bottom portion of said track contiguous with and extending substantially the distance between said die stations, said hollow tube member having a diameter much less than the transverse distance between said opposed side walls and further having a plurality of openings therein, said openings being shaped to provide air flow velocity components directed both upwardly and toward said curling die station when a flow of air is supplied therethrough.

2. The shell press of claim 1 wherein said fluid conveyor means further comprises:

an upwardly facing surface, and wherein said pair of opposed side walls extend substantially the length of said upwardly facing surface, and a downwardly facing surface disposed above said upwardly facing surface and extending substantially the length thereof, said facing surfaces and side walls generally defining therebetween an elongated space extending between said die stations, said hollow tube member being contiguous with and extending the length of said elongated space, said openings in said hollow tube member providing fluid communication between said hollow tube member and said elongated space, and means for supplying a flow of air through said hollow tube member for fluidly conveying shells through said elongated space to said curling die station by the flow of air passing through said shaped openings.

3. The shell press of claim 2 wherein said openings are stamped from respective portions of said hollow tube member, said stamped portions having respective end parts remaining integral to said hollow tube member and respective opposite end parts disposed in the interior space of said hollow tube member and toward a flow of air supplied therethrough to scoop some of the flow of air through respective said openings.

4. The shell press of claim 3 wherein said stamped portions are generally arcuately shaped having their respective convexly-shaped surfaces generally inwardly facing into the interior space of said hollow tube member and their respective concavely-shaped surfaces generally outwardly facing therefrom and in the direction of said elongated space.

5. The shell press of claim 4 wherein said openings in said hollow tube member are axailly in line and circularly shaped.

6. The shell press of claim 2 wherein said opposed side walls are upstanding from said upwardly facing surface, the transverse distance between said side walls being greater than the diameter of a shell to be conveyed.

7. The shell press of claim 6 wherein said downwardly facing surface is disposed from one of said side walls and has a remote end above said upwardly facing surface, and further including:

a second downwardly facing surface being disposed from the other of said side walls and having a remote end above said upwardly facing surface, said remote ends being spaced apart a transverse distance less than the diameter of a shell to be conveyed.

8. The shell press of claim 7 wherein said hollow tube member is disposed in said upwardly facing surface.

9. The shell press of claim 1 wherein said ejecting means is positively driven and synchronized with said slide assembly.

10. In a press installation including at least two die stations, an air transfer apparatus for moving parts from a first one of said die stations to the second one of said die stations, comprising:

track means extending between said die stations for guiding parts from said first die station to said second die station, said track means comprising an upwardly facing surface, opposed side walls extending substantially the length of said upwardly facing surface, and a pair of downwardly facing surfaces extending inwardly from said opposing side walls and disposed above said upwardly facing surface and extending substantially the length thereof, said downwardly facing surfaces having a combined width less than the width of said upwardly facing surfaces, said facing surfaces and side walls generally defining therebetween an elongated space extending between said die stations, a hollow conduit being disposed in said track means below said downwardly facing surfaces, said conduit connected to a source of air located remotely from said track means, said conduit having a diameter much smaller than the transverse distance between said opposed side walls of said track means, said hollow conduit having a plurality of openings to provide fluid communication between said conduit and said elongated space, said openings being shaped to provide air flow velocity components in said elongated space directed both upwardly and towards said second die station when a flow of air is supplied through said conduit, and means for supplying a flow of air through said conduit, whereby a part to be ejected from said first die station onto said upwardly facing surface of said track means will be fluidly conveyed through said elongated space to said second die station by the flow of air being emitted through said shaped openings of said conduit.

11. The installation of claim 10 wherein said conduit is a tube member and said openings are stamped from respective portions of said tube member, said stamped portions having respective end parts remaining integral to said tube member and respective opposite remote end parts disposed in the interior space of said tube member and toward a flow of air supplied therethrough to direct a portion of the air flow through respective said openings.

12. The installation of claim 11 wherein said stamped portions are generally arcuately-shaped having their respective convexly-shaped surfaces generally inwardly facing into the interior space of said tube member and their respective concavely-shaped surfaces generally outwardly facing therefrom and in the direction of said elongated space.

13. The installation of claim 12 wherein said openings in said tube member are axially aligned and circularly-shaped.

14. The installation of claim 13 further including a plurality of track means for guiding a plurality of parts from said first die station to said second die station.

15. The installation of claim 10 wherein said opposed side walls are upstanding from said upwardly facing surface.

16. The installation of claim 15 wherein said tube member is disposed in said upwardly facing surface.

17. The installation of claim 16 further including a plurality of track means for guiding a plurality of parts from said first die station to said second die station.

18. In a press including a reciprocating slide member and a die station having a pair of cooperating tool elements therein, one of said tool elements being connected to said reciprocating slide member for reciprocative movement relative to the other of said tool elements for performing a shaping operation on a part, a pneumatic transfer system comprising:

fluid conveyor means leading to said die station for conveying a part to be shaped to said die station, track means leading from said die station for guiding a shaped part away from said die station, a first wall member being disposed between said fluid conveyor means and said die station and connected to said reciprocating slide member to reciprocate therewith, said first wall member having an opening therein, a second wall member being disposed between said track means and said die station and connected to said reciprocating slide member to reciprocate therewith, said second wall member having an opening therein, air pulse means for directing a pulsed flow of air into said die station against a shaped part located in said die station, and means for reciprocating said slide member downwardly from an uppermost position to an intermediate position wherein said first wall member opening is aligned with said fluid conveyor means and said second wall member opening is out of alignment with said track means to permit a part to be shaped to be fluidly conveyed into sid die station, then moving said slide member to a lowermost position wherein the part to be shaped is held in place between said tool elements, and then moving said slide member upwardly from said lowermost position to a predetermined position wherein said second wall member opening is aligned with said track means, said air pulse means directing a pulsed flow of air against the shaped part to eject it through said second wall member opening to said track means.

19. The press of claim 18 wherein said fluid conveyor means comprises an upwardly facing surface, opposed side walls extending substantially the length of said upwardly facing surface, and a downwardly facing surface disposed above said upwardly facing surface and extending substantially the length thereof, said downwardly facing surface having a width less than the transverse distance between said side walls, said facing surfaces and side walls generally defining therebetween an elongated space leading to said die station, a hollow tube member being contiguous with and extending the length of said elongated space, said hollow tube member having a diameter much less than said transverse distance between said opposed side walls and further having a plurality of openings to provide fluid communication between said hollow tube member and said elongated space, said openings being shaped to provide air flow velocity components in said elongate space directed both upwardly and towards said die station when a flow of air is supplied through said hollow tube member, and means for supplying a flow of air through said hollow tube member, whereby a part to be shaped is fluidly conveyed through said elongated space to said die station by the flow of air emitting through said shaped openings.

20. The press of claim 19 wherein said openings of said hollow tube member are formed from respective portions of said hollow tube member, each of said portions having an end part remaining integral with said hollow tube member and an opposite end part disposed within the interior space of said hollow tube member to direct a flow of air through its respective opening.

21. The press of claim 20 wherein said portions of said hollow tube member are generally arcuately-shaped having their respective convexly-shaped surfaces generally inwardly facing into the interior space of said hollow tube member and their respective concavely-shaped surfaces generally outwardly facing in the direction of said elongated space.

22. The press of claim 21 wherein said openings in said hollow tube member are axially in line and circularly shaped.

23. The press of claim 22 wherein said guiding track means fluidly conveys a shaped part away from said die station.

24. The press of claim 18 wherein said slide member is reciprocated by said reciprocating means from said upper most position to said lower most position and back to said upper most position in a continuous motion.

25. The press of claim 18 further including a sleeve member being disposed about said one tool element and connected to said reciprocating slide member to reciprocate therewith, and wherein said first and second wall members are integral to said sleeve member.

26. The press of claim 18 wherein said first wall member has a second opening therein, and wherein said providing means includes a conduit leading to said first wall member to deliver a flow of air thereto, said conduit and said second opening in said first wall member being aligned with a part to be shaped in said die station when said slide member is at said predetermined position, whereby a pulsed flow of air is delivered through said second opening for ejecting a shaped part through said second wall member opening to said track means.

27. The press of claim 26 wherein said providing means includes a controllable source of air flow connected to said conduit, and control means operatively connected to said controllable source for sensing when said slide member is at said predetermined position to cause said controllable source to deliver a pulsed flow of air through said conduit.

28. A method for fluidly conveying a part through a die station in a press for performing a shaping operation on the part, said press including a reciprocating slide member and a pair of cooperating tool elements in said die station, one of said tool elements being connected to said reciprocating slide member for reciprocative movement relative to the other of said tool elements for performing said shaping operation, a fluid conveyor leading to said die station, a first wall member disposed between said fluid conveyor and said die station and connected to said reciprocating slide member to reciprocate therewith, said first wall member having an opening therein, a second wall member disposed between a track and said die station and connected to said reciprocating slide member to reciprocate therewith, said second wall member having an opening therein, a source of pulsed air for directing a pulsed flow of air into said die station against a part located in said die station, and the track leading from said die station for conveying a shaped part away from said die station, said method comprising:

aligning said opening in said first wall member with said fluid conveyor means;

fluidly conveying a part to be shaped through said aligned opening in said first wall member into said die station;

shaping said part with said tool elements in said die station;

aligning said opening in said second wall member with said track;

directing a pulsed flow of air against said shaped part in said die station; and ejecting said part with said pulsed flow of air from said die station onto said track.

* * * * *

UNITED STATES PATENT AND TRADEMARK OFFICE

CERTIFICATE OF CORRECTION

PATENT NO. : 4,554,814

DATED : November 26, 1985

INVENTOR(S) : Arthur L. Grow et al.

It is certified that error appears in the above-identified patent and that said Letters Patent is hereby corrected as shown below:

Col. 2, line 18 change "use" to --uses--.

Col. 2, line 34, change "waffers" to --wafer--.

Col. 2. line 65, change "feature" to --features--.

Col. 5, line 29, change "in" to --is--.

Col. 5, line 60, change "32" to --42--.

Col. 6, line 61, change "surfaces" to --surface--.

Cl. 10, Col. 11, line 39, change "surfaces" first occurrence to --surface--.

Cl. 18, Col. 12, line 54, change "sid" to --said--.

Signed and Sealed this

*Twenty-second* Day of *April 1986*

[SEAL]

*Attest:*

DONALD J. QUIGG

*Attesting Officer* *Commissioner of Patents and Trademarks*